US006935350B2

(12) United States Patent
Nakamura

(10) Patent No.: US 6,935,350 B2
(45) Date of Patent: Aug. 30, 2005

(54) HAIRBRUSH

(76) Inventor: Tetuji Nakamura, 3400-1, Tabeta Kawanabe-cho, Kawanabe-gun, Kagoshima (JP)

( * ) Notice: Subject to any disclaimer, the term of this patent is extended or adjusted under 35 U.S.C. 154(b) by 252 days.

(21) Appl. No.: 10/458,521

(22) Filed: Jun. 10, 2003

(65) Prior Publication Data

US 2003/0234026 A1 Dec. 25, 2003

(30) Foreign Application Priority Data

Jun. 21, 2002 (JP) ..... 2002-181515
Aug. 22, 2002 (JP) ..... 2002-241610

(51) Int. Cl.[7] ..... A45D 24/38
(52) U.S. Cl. ..... 132/144
(58) Field of Search ..... 132/144, 120, 132/136, 141, 150, 147, 148; 15/160, 169

(56) References Cited

U.S. PATENT DOCUMENTS 4,475,563 A * 10/1984 Martin ..... 132/136
5,626,153 A * 5/1997 Petrarca ..... 132/126

* cited by examiner

*Primary Examiner*—John J. Wilson
*Assistant Examiner*—Robyn Doan
(74) *Attorney, Agent, or Firm*—Koda & Androlia

(57) ABSTRACT

A hairbrush includes a brush base having a plurality of brushing bristles, a handle provided thereto, a hair holder extending longitudinally along with the brush base and a control member making the hair holder extend and shorten longitudinally. The control member and an entire body except for at least a tip portion of the hair holder are positioned at the handle. The hair holder is extended and shortened by the control member within an area ranging from "a back position" where the hair holder is shortened to be provided to the handle as mentioned above to "a front position" where the hair holder is extended so that a tip portion thereof reaches near a front edge of the brush base. When the hair holder is extended to the front position, hair is received between the brush base and the hair holder. The hairbrush enables a user to style hairdos beautifully without much experience by blowing hair to flow softly or giving hair waves.

64 Claims, 13 Drawing Sheets

HAIRBRUSH

BACKGROUND OF THE INVENTION

1. Field of the Invention

The present invention relates to a hairbrush that enables a user to style hairdos beautifully without much experience by blowing hair to flow softly or giving hair waves and curls.

2. Description of the Prior Art

In case of styling hairdos by giving hair waves and curls with a hairbrush, hair is first caught and entangled around a brush base having brushing bristles. While keeping this condition, hair is then blown warm air with a hairdryer.

In case of a conventional hairbrush, although hair is tightly caught and entangled around the above mentioned brush base, hair slowly slips off the brush base and the brushing bristles.

Therefore, styling hairdos beautifully by giving hair waves and curls with the conventional hairbrush is not easy for a user having little experience.

Similarly, in case of styling hairdos by blowing hair (to make hair flow softly) with the conventional hairbrush, a user need much experience.

In recent years, people, regardless of sex, wish for a hairbrush to be developed and put on the market that enables them to style hairdos beautifully without much experience by blowing hair or giving hair waves and curls.

There has been a conventional hairbrush that includes a brush base having brushing bristles and, connecting thereto, a handle having a hair pressing body including a protruding manipulating portion. The hair pressing body is movable upward (hereinafter referred to as "opened") with respect to the brush base to provide a space therebetween and movable downward (hereinafter referred to as "closed") onto the brush base. To style hairdos with this hairbrush, the pressing body being opened, hair is placed between the brush base and the hair pressing body, and the hair pressing body being closed, hair is held therebetween. In this hairbrush, due to the existence of the protruding manipulating portion, unwanted excess hair is caught and entangled around the hair pressing body. Therefore, the conventional hairbrush is difficult to use and much experience is required.

SUMMARY OF THE INVENTION

It is hence an object of the present invention to provide a hairbrush that enables a user to style hairdos beautifully without much experience by blowing hair to flow softly or giving hair waves and curls.

In order to solve the above stated problems, a hairbrush according to the present invention includes a brush base having a plurality of brushing bristles, a handle provided thereto, a hair holder extending longitudinally along with the brush base and a control member making the hair holder extend and shorten longitudinally. The control member and an entire body except for at least a tip portion of the hair holder are positioned at the handle. The hair holder is extended and shortened by the control member within an area ranging from "a back position", where the hair holder is shortened to be positioned at the handle as mentioned above, to "a front position", where the hair holder is extended so that a tip portion thereof reaches near a front edge of the brush base. When the hair holder is extended to the front position, hair is received between the brush base and the hair holder.

Furthermore, in the hairbrush according to the present invention, the handle may be formed to be hollow so that the control member and an entire body except for at least a tip portion of the hair holder may be housed in a hollow handle.

Moreover, in the hairbrush according to the present invention, there may be no brushing bristles on a path which the hair holder moves through.

In addition, in the hairbrush according to the present invention, a stopper may be provided near the front edge of the brush base to abut the hair holder being extended to the front position.

Further, in the hairbrush according to the present invention, the brushing bristles may be made of at least one of hard bristles and bundles of bristles and they may be implanted on the brush base.

Still more, in the hairbrush according to the present invention, more than one hair holders may be provided.

The functions, features and advantages of the present invention will become apparent from the following description.

DETAILED DESCRIPTION OF THE INVENTION (Embodiment 1)

Figure 1:
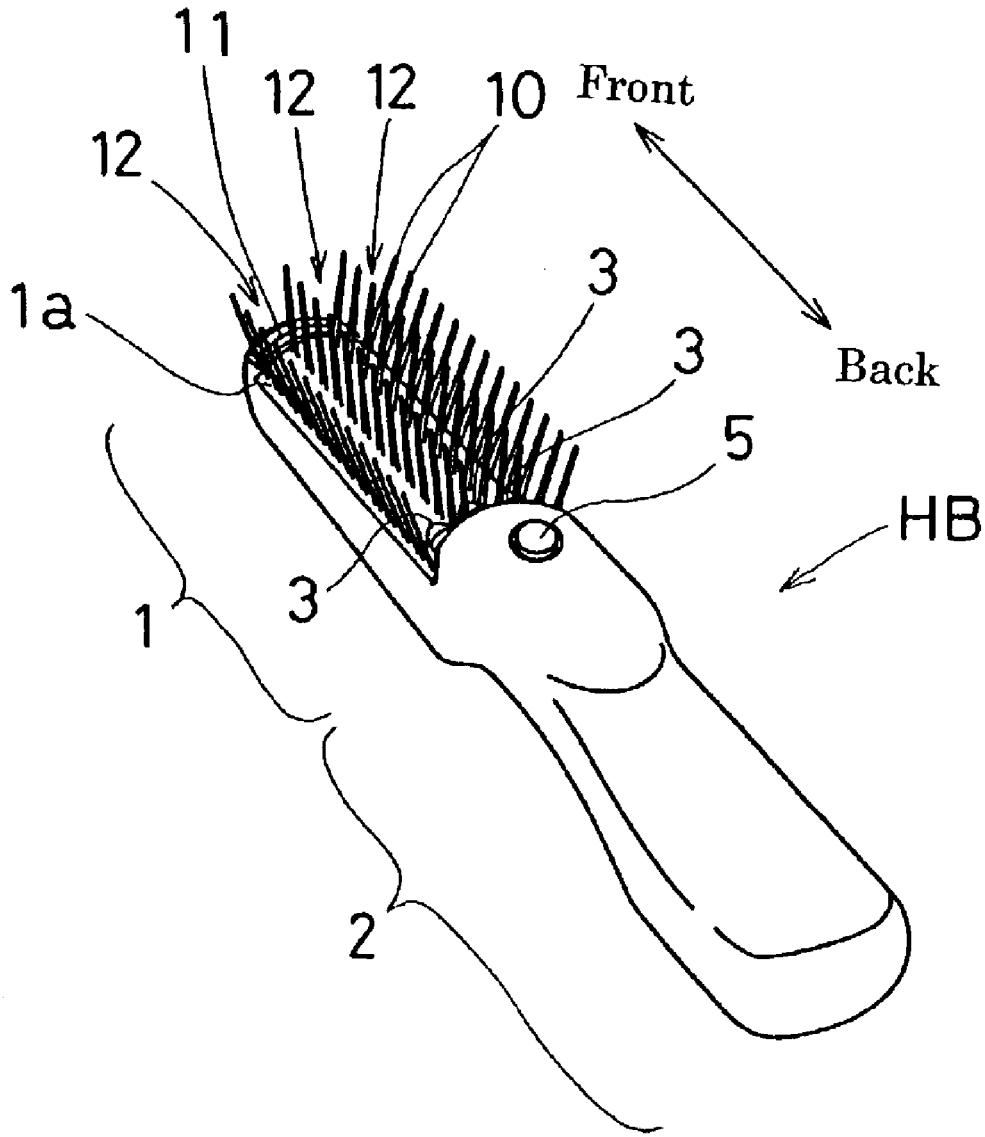
FIG. 1 is an external perspective view of Embodiment 1 of a hairbrush according to the present invention.
Figure 2:
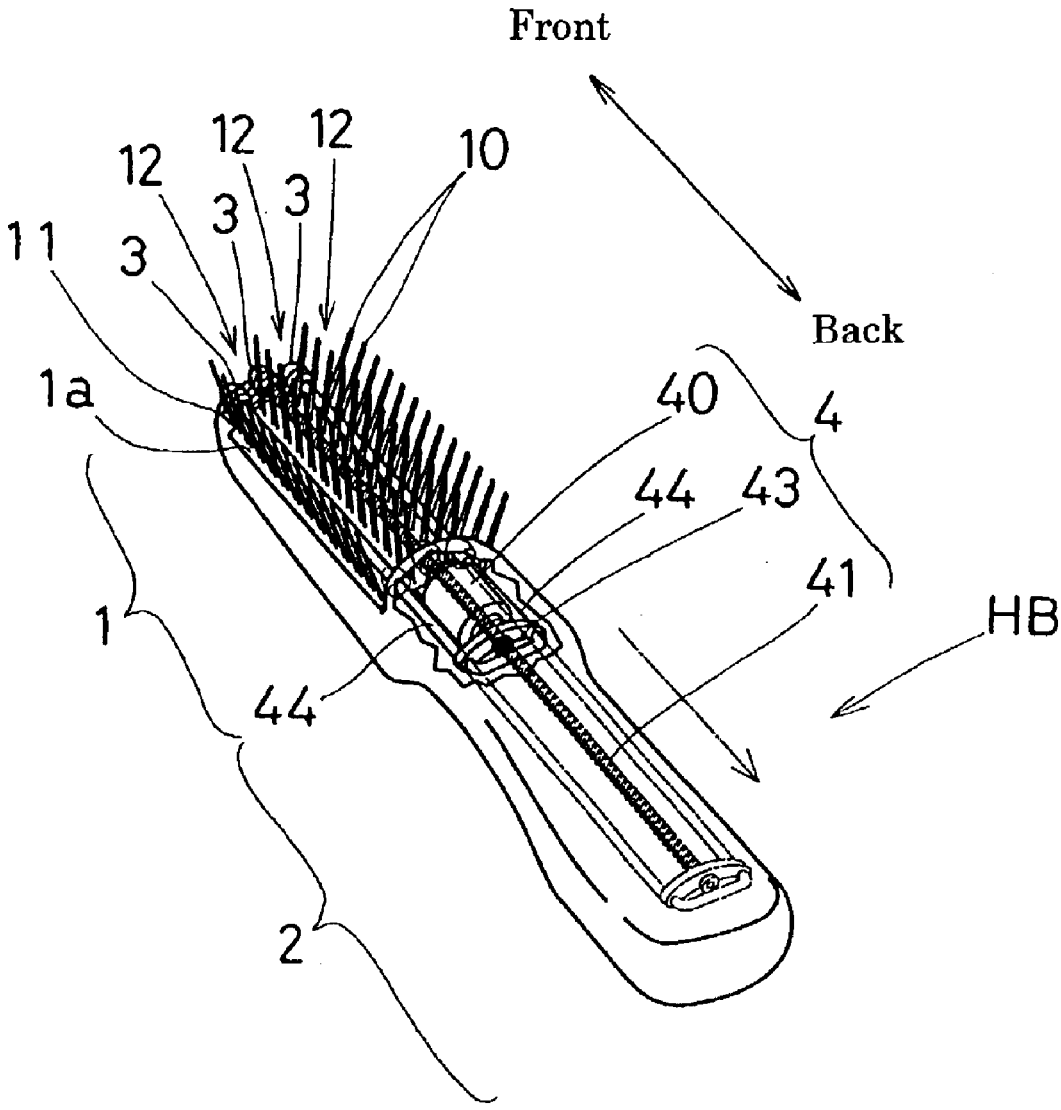
FIG. 2 is a partial sectional view of the hairbrush according to the present invention.
Figure 3:
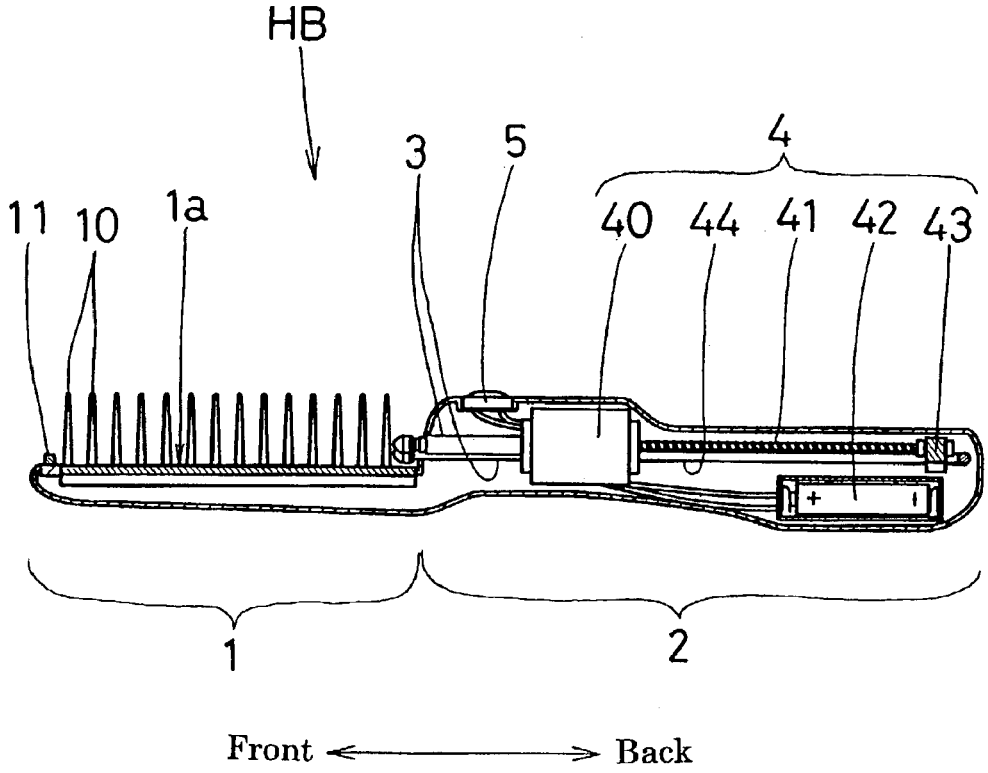
FIG. 3 is a sectional view of the hairbrush according to the present invention, wherein a hair holder is shortened to "a back position".
Figure 4:
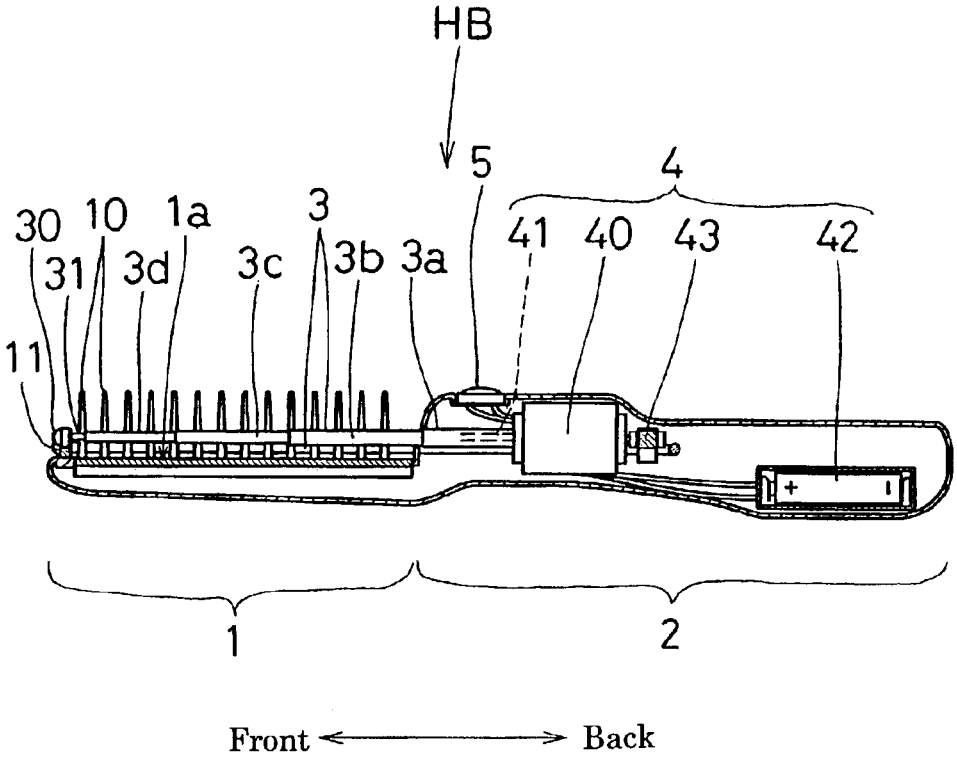
FIG. 4 is a sectional view of the hairbrush according to the present invention, wherein the hair holder is extended to "a front position".

FIG. 1 is an external perspective view of Embodiment 1 of a hairbrush HB according to the present invention. FIG. 2 is a partial sectional view of the hairbrush HB. FIG. 3 and FIG. 4 are sectional views of the hairbrush HB seen from the side of the hairbrush.

As shown in FIG. 1 and FIG. 3, the hairbrush HB of this embodiment includes a brush base 1 having a plurality of brushing bristles 10 and a hollow handle 2 provided thereto.

As shown in FIG. 1, the brush base 1 includes a smoothly arc-shaped base plate 1*a* on which a plurality of brushing bristles 10 that are made of hard bristles are implanted. The brushing bristles 10 are arranged to form four lines longitudinally along with the brush base 1. As a result, in this hairbrush HB, three paths of space 12 are formed between the lines of the brushing bristles 10 longitudinally along with the brush base 1.

As shown in FIG. 1 or FIG. 4, the brush base 1 also includes a stopper 11 near a front edge that is made of a magnet.

As shown in FIG. 3 or FIG. 4, the handle 2 is formed to be hollow so that almost an entire body of three hair holders 3 is housed inside that extends longitudinally along with the brush base 1 (FIG. 3). The hollow handle 2 also houses a control member 4 inside that makes the hair holder 3 extend and shorten longitudinally. As clearly shown in FIG. 3 or FIG. 4, the hair holder 3 is extended and shortened by the control member 4 within an area ranging from "a back position" where the hair holder 3 is shortened to be housed in the handle 2 as mentioned above (FIG. 3) to "a front position" where the hair holder 3 is extended so that a tip portion thereof reaches near a front edge of the brush base 1 (FIG. 4).

As shown in FIG. 4, the hair holder 3 includes four pipes; the largest-diameter pipe 3*a*, the second largest-diameter pipe 3*b*, the third largest-diameter pipe 3*c* and the smallest-diameter pipe 3*d*. The smallest-diameter pipe 3*d* is provided with a shaft 31 having an enlarged-diameter part 30 that is made of magnetic metal. The four pipes are respectively connected to be capable of sliding on each other and not to come off from each other (like an extendable antenna). The smallest-diameter pipe 3*d* and the shaft 31 are also connected together in the same way. As shown in FIG. 2, each of tip portions of the three hair holders 3 is facing to the space 12 to move through the three paths of space 12.

As shown in FIG. 2 through FIG. 4, the control member 4 includes motor 40, an output shaft 41, a battery 42 to drive the motor 40, a plate 43 provided at a back end of the output shaft 41 and two shaft bodies 44 moving simultaneously with the output shaft 41 via the plate 43. The motor 40 makes the output shaft 41 move straight although a common motor makes an output shaft rotate. In this hairbrush HB, the motor 40 and a switch 5 that is electrically connected with the battery 42 are disposed near the brush base 1 in the handle 2 (FIG. 3). A front part of the switch 5 is pressed so that the output shaft 41 moves forward and conversely a back part of the switch 5 is pressed so that the output shaft 41 moves backward. The force to press the switch 5 is released so that the motor 40 stops driving to prevent the output shaft 41 from moving.

Although not shown in drawings, all of the largest-diameter pipes 3*a* of the three hair holders 3 are fixed on a front end wall constituting the handle 2. A back end of a middle shaft 31 and a front end of the output shaft 41, and back ends of left and right shafts 31 and front ends of left and right shaft bodies 44 are connected respectively.

Therefore, when the front part of the switch 5 is pressed, the output shaft 41 and the two shaft bodies 44 move forward so that each of the three hair holders 3 is extended as shown in FIG. 4 and each of the enlarged-diameter parts 30 reaches the above mentioned front position to be magnetically attached to a stopper 11. When the back part of the switch 5 is pressed, the output shaft 41 and the two shaft bodies 44 move backward so that each of the three hair holders 3 is shortened as shown in FIG. 3 and each of the enlarged-diameter parts 30 returns to the above mentioned back position. When the force pressing the switch 5 is released, each of the three hair holders 3 comes to stop moving.

The way how the above mentioned hairbrush HB is applied to get a desired hair style will become apparent from the following description.

A. How to Give Hair Waves and Curls.

Figure 5:
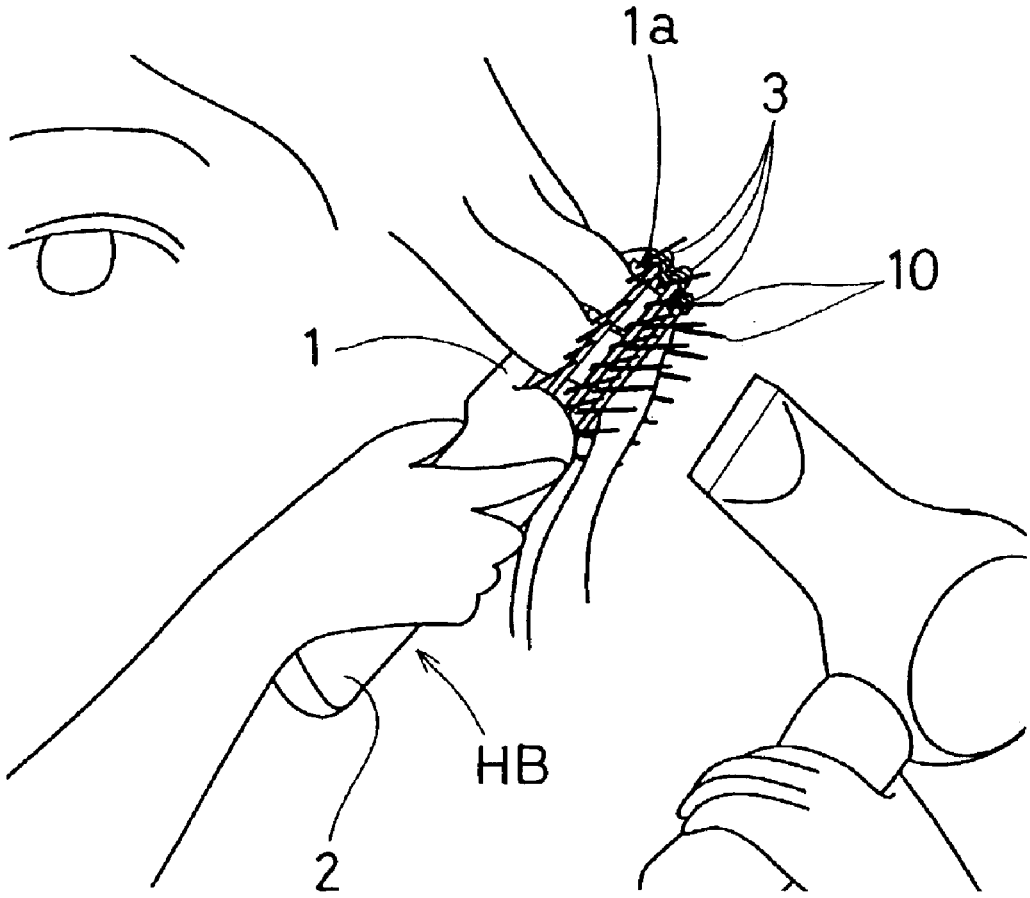
FIG. 5 is a view showing how hair is treated by the hairbrush according to the present invention.

① After putting root side of hair on the base plate 1*a* (See FIG. 5), move the hairbrush HB to the middle of hair like combing hair with the brushing bristles 10

② While keeping the hairbrush HB in the above mentioned position, the front part of the switch 5 is pressed so that each of the three hair holders 3 is extended to the front position with sliding on hair and hair is received between the hair holder 3 and the base plate 1*a* of the brush base 1.

③ Move the hairbrush HB to a position where to give hair waves and curls and then roll the hairbrush HB into hair so that hair is caught and entangled around the brush base 1. During this treatment, because hair is tightly received between the hair holder 3 and the base plate 1*a* of the brush base 1, hair hardly slips on the hairbrush HB and hair hardly slips off the base plate 1*a* of the brush base 1.

④ While keeping this condition, blow warm air to hair with a hairdryer.

⑤ The back part of the switch 5 is pressed so that each of the three hair holders 3 is shortened to the back position. In this back position, because hair is no longer received between the hair holder 3 and the base plate 1*a*, the hairbrush HB is easily removed from hair.

B. How to Blow Hair (To Make Hair Flow Softly).

① Put root side of hair on the base plate 1*a* like combing hair with the brushing bristles 10.

② The front side of the switch 5 is pressed so that each of the three hair holders 3 is extended to the front position with sliding on hair and hair is received between the hair holder 3 and the base plate 1*a*. (See FIG. 5.)

③ Move the hairbrush HB toward a tip side of hair like stretching hair while blowing warm air to hair with a hairdryer. During this treatment, because hair is received between the hair holder 3 and the base plate 1*a* of the brush base 1, hair is unlikely to slip on the hairbrush HB smoothly. This gives hair moderate strong tension and makes blowing hair easy.

④ After a tip portion of hair slips off between the hair holder 3 and the base plate 1*a*, the back side of the switch 5 is pressed so that each of the three hair holders 3 is shortened to the back position.

C. Fundamental Effects Gained by Using this Hairbrush to Blow Hair or to Give Hair Waves and Curls.

As mentioned above, in case of this hairbrush HB, hair does not slip off the base plate 1*a* differently from the conventional hairbrush described in the "Description of the Prior Art". Therefore, compared to the conventional hairbrush, a user can easily blow hair or give hair waves and curls with less experience.

Furthermore, in case of this hairbrush HB, the hair holder 3 is extended ("moved" in Embodiment 2 and Embodiment 3) parallel to the base plate 1*a* and a tip portion of the hair holder 3 reaches to the front position. Therefore, unwanted excess hair is unlikely caught and entangled with the hair holder 3 differently from the conventional hairbrush described in the latter half of the "Description of the Prior Art".

(Embodiment 2)

Figure 6:
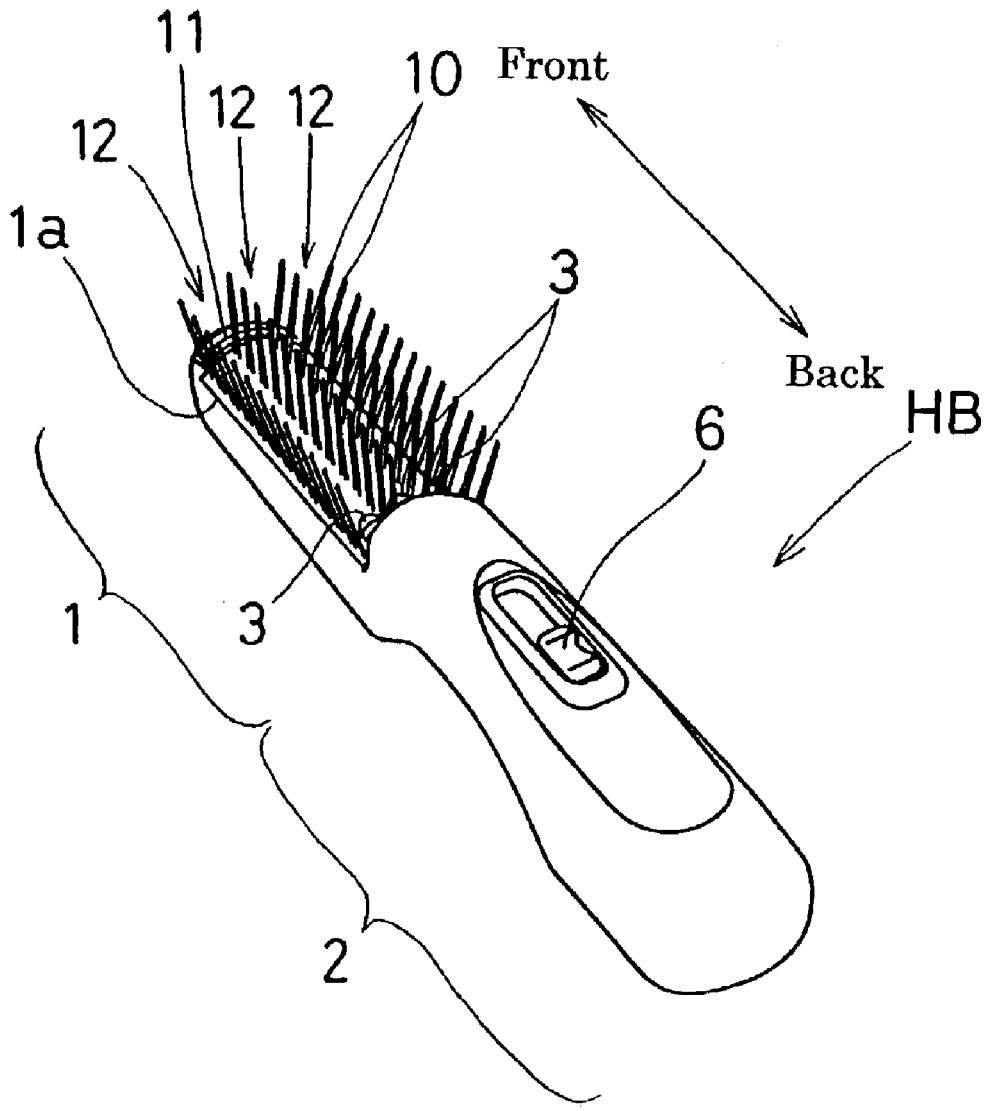
FIG. 6 is a perspective view of Embodiment 2 of a hairbrush according to the present invention.
Figure 7:
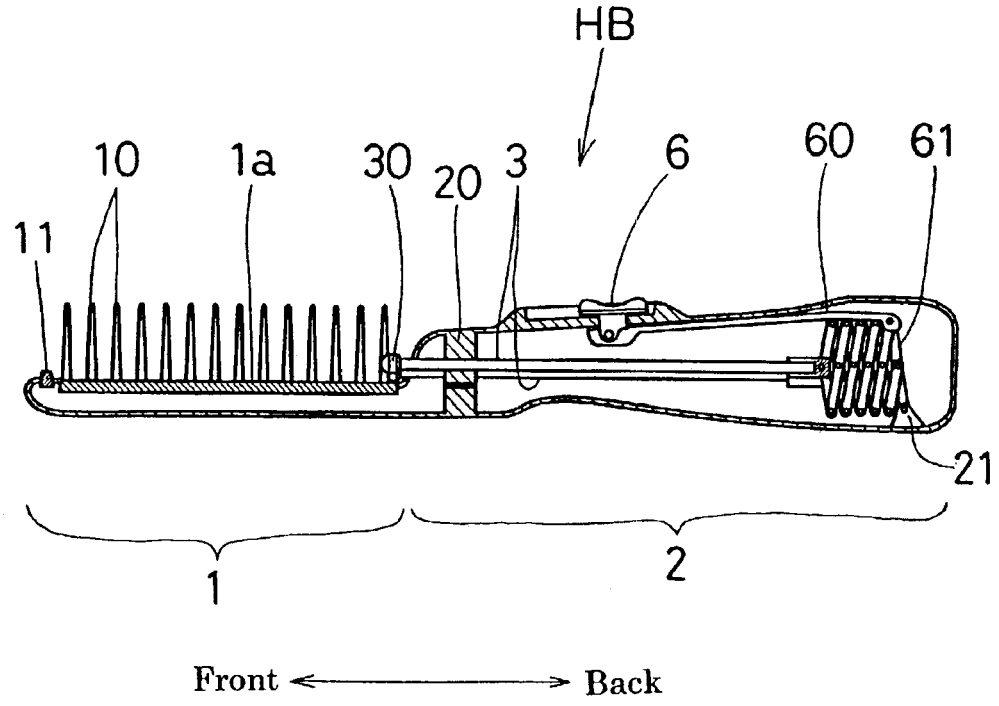
FIG. 7 is a sectional view of Embodiment 2 of the hairbrush according to the present invention, wherein a hair holder is shortened to "a back position".
Figure 8:
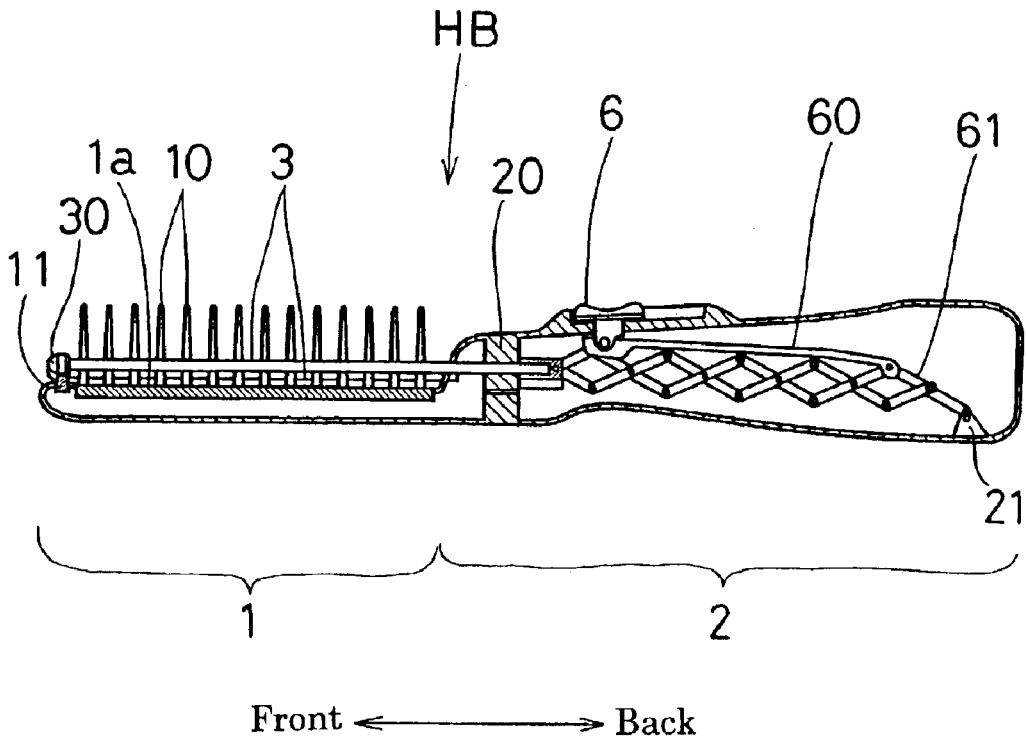
FIG. 8 is a sectional view of Embodiment 2 of the hairbrush according to the present invention, wherein the hair holder is extended to "a front position".

FIG. 6 is an external perspective view of Embodiment 2 of a hairbrush HB according to the present invention. FIG. 7 and FIG. 8 are sectional views of the hairbrush HB.

As shown in FIG. 6 through FIG. 8, the hairbrush HB includes a controller 6, a lever 60, a bracket 21 and lazy tongs 61. The lever 60 is controlled by making the controller 6 slide to a front side or a back side of the hairbrush HB. The lazy tongs 61 that is pivotally attached to the bracket 21 is extended and shortened via the lever 60 so that each of three hair holders 3 attached to a front end of the lazy tongs 61 is moved to "a front position" as shown in FIG. 8 and to "a back position" as shown in FIG. 7.

The hair holder 3 of this embodiment is made from one simple rod that is not extendable differently from that of Embodiment 1 and provided with an enlarged-diameter part 30 at a front end portion that is made of magnetic metal.

In this embodiment, the controller 6 has the same function as the control member 4 of Embodiment 1 although both the lever 60 and the lazy tongs 61 are controlled by a user's finger, not a motor.

The hair holder 3 is slidably supported by a vertical wall 20 provided within a handle 2 so that the hair holder 3 can move possibly parallel to a base plate 1*a* of a brushing base 1 even if the lazy tongs 61 comes down because of its own weight. (FIG. 8) As a result, the hairbrush HB of this embodiment can produce the same effects as the hairbrush HB of Embodiment 1.

(Embodiment 3)

Figure 9:
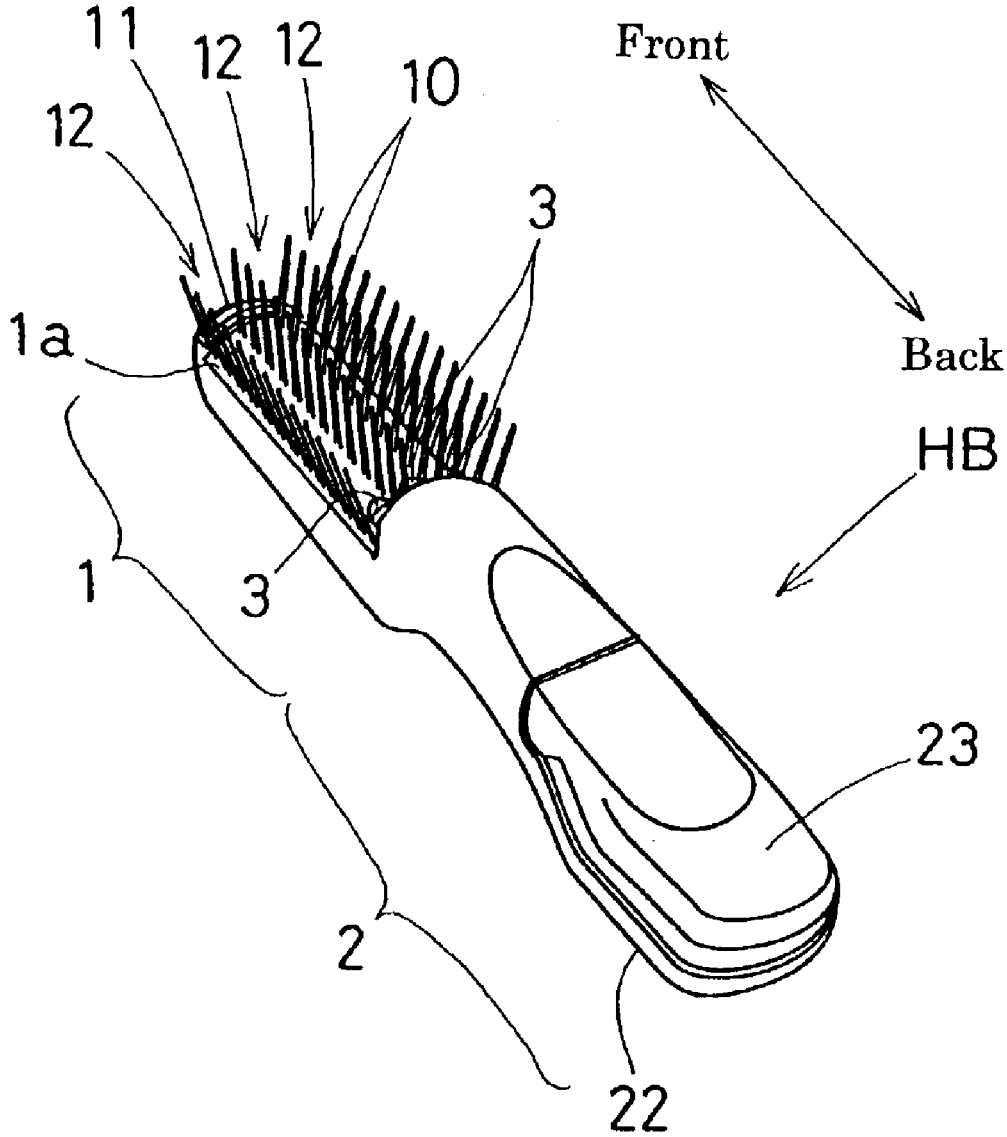
FIG. 9 is a perspective view of Embodiment 3 of a hairbrush according to the present invention.
Figure 10:
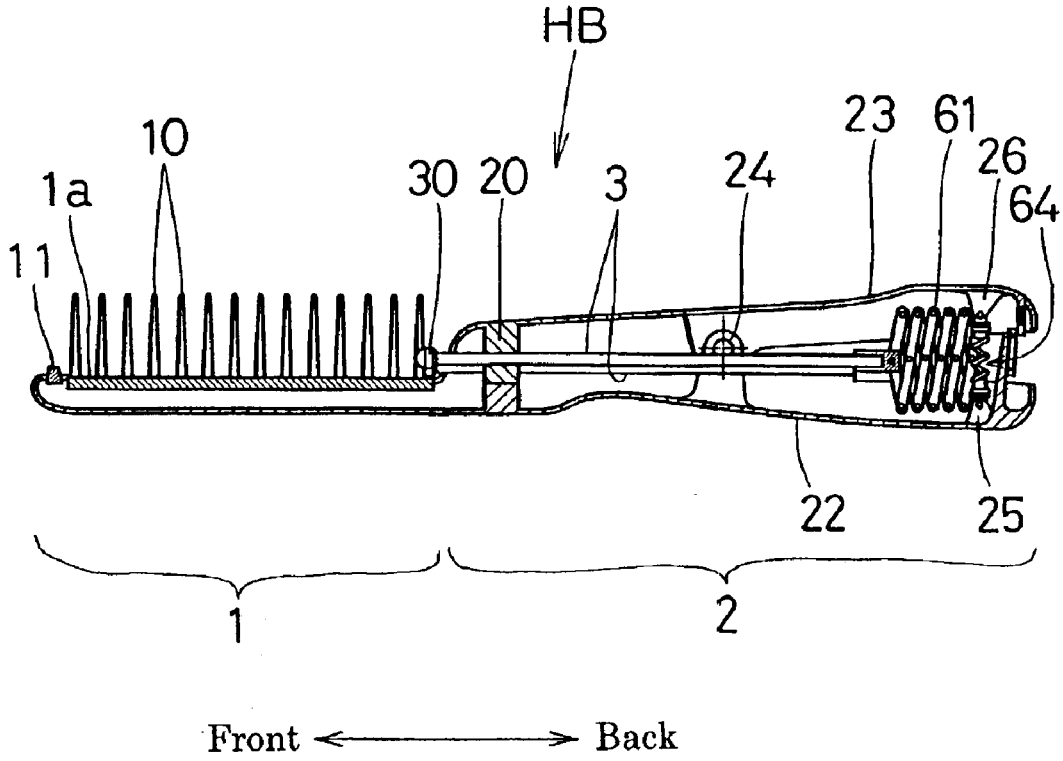
FIG. 10 is a sectional view of Embodiment 3 of the hairbrush according to the present invention, wherein a hair holder is shortened to "a back position".
Figure 11:
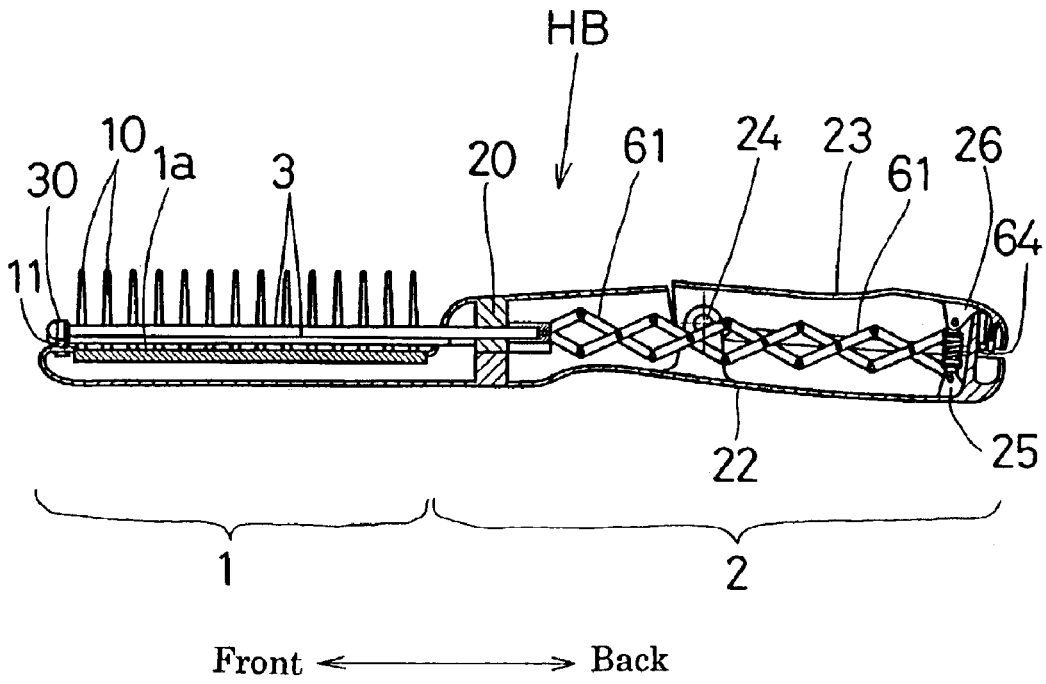
FIG. 11 is a sectional view of Embodiment 3 of the hairbrush according to the present invention, wherein the hair holder is extended to "a front position".

FIG. 9 is an external perspective view of Embodiment 3 of a hairbrush HB according to the present invention. FIG. 10 and FIG. 11 are sectional views of the hairbrush HB.

As shown in FIG. 9 through FIG. 11, in the hairbrush HB of this embodiment, each of three hair holders 3 is simultaneously moved forward and backward in the same function of the lazy tongs 61 of the hairbrush HB of Embodiment 2. However, the hairbrush HB of this embodiment is different from that of Embodiment 2 in that the hair holder 3 is moved to "a front position" by holding an end portion of a handle 2 and returned to "a back position" by loosing the hold of the handle 2.

As shown in FIG. 10 and FIG. 11, the handle 2 of this embodiment includes a main body 22 and a wall part 23 that is pivotally attached to a shaft 24 provided in the longitudinal middle of the main body 22. A bracket 25 provided in the main body 22 and a bracket 26 provided in the wall part 23 are respectively connected with a compression coil spring 64 so that both back end portions of the main body 22 and the wall part 23 are forced to open. (FIG. 10)

As shown in FIG. 10 and FIG. 11, back end lever portions of the lazy tongs 61 are respectively pivotally attached to the bracket 25 and the bracket 26. The back end portion of the wall part 23 is pressed down to the main body 22 against the compression coil spring 64 so that the lazy tongs 61 is extended from the back position shown in FIG. 10 to the front position shown in FIG. 11. The hair holder 3 is slidably supported by a vertical wall 20 provided in the handle 2.

As a result, the hairbrush HB of this embodiment can produce the same effects as the hairbrush HB of Embodiment 1.

(Embodiment 4)

Figure 12:
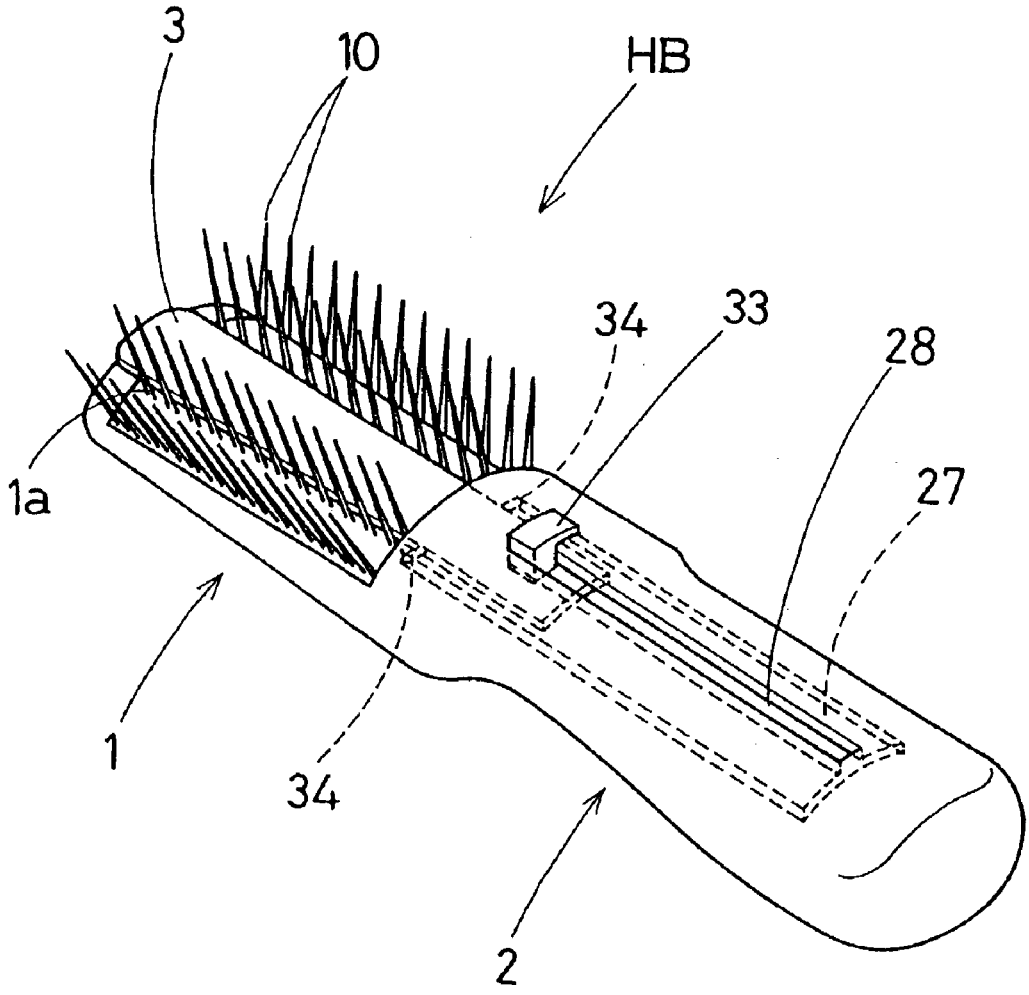
FIG. 12 is a perspective view of Embodiment 4 of a hairbrush according to the present invention.

FIG. 12 is an external perspective view of Embodiment 4 of a hairbrush HB according to the present invention.

As shown in FIG. 12, in the hairbrush HB of this embodiment, a handle 2 includes a space 27, a controller 33 and a penetration 28. The space 27 is provided with a single wide and flat hair holder 3 that is slidable and prevented from slipping off the handle 2. The controller 33 projected from the penetration 28 is provided on an end side of the hair holder 3 that is inserted into the space 27 therefrom. The penetration 28 having a longitudinal length is provided on a constitutional wall of the space 27.

As shown in FIG. 12, the hair holder 3 has a curved shape along a base plate 1*a* so that hair is received by entire surface of the hair holder 3. The hair holder 3 is moved to "a front position" or "a back position" by pushing or pulling the controller 33 with a user's finger.

As shown in FIG. 12, the controller 33 is abutted against a front side wall of the penetration 28 and stoppers 34 provided on left and right sides of the hair holder 3 are also abutted against a front side wall of the space 27 so that the hair holder 3 is prevented from coming off the handle 2.

In this embodiment, the controller 33 has the same function as the control member 4 of Embodiment 1 although the controller 33 is controlled by a user' finger.

As a result, the hairbrush HB of this embodiment can produce the same effects as the hairbrush HB of Embodiment 1.

(Embodiment 5)

Figure 13:
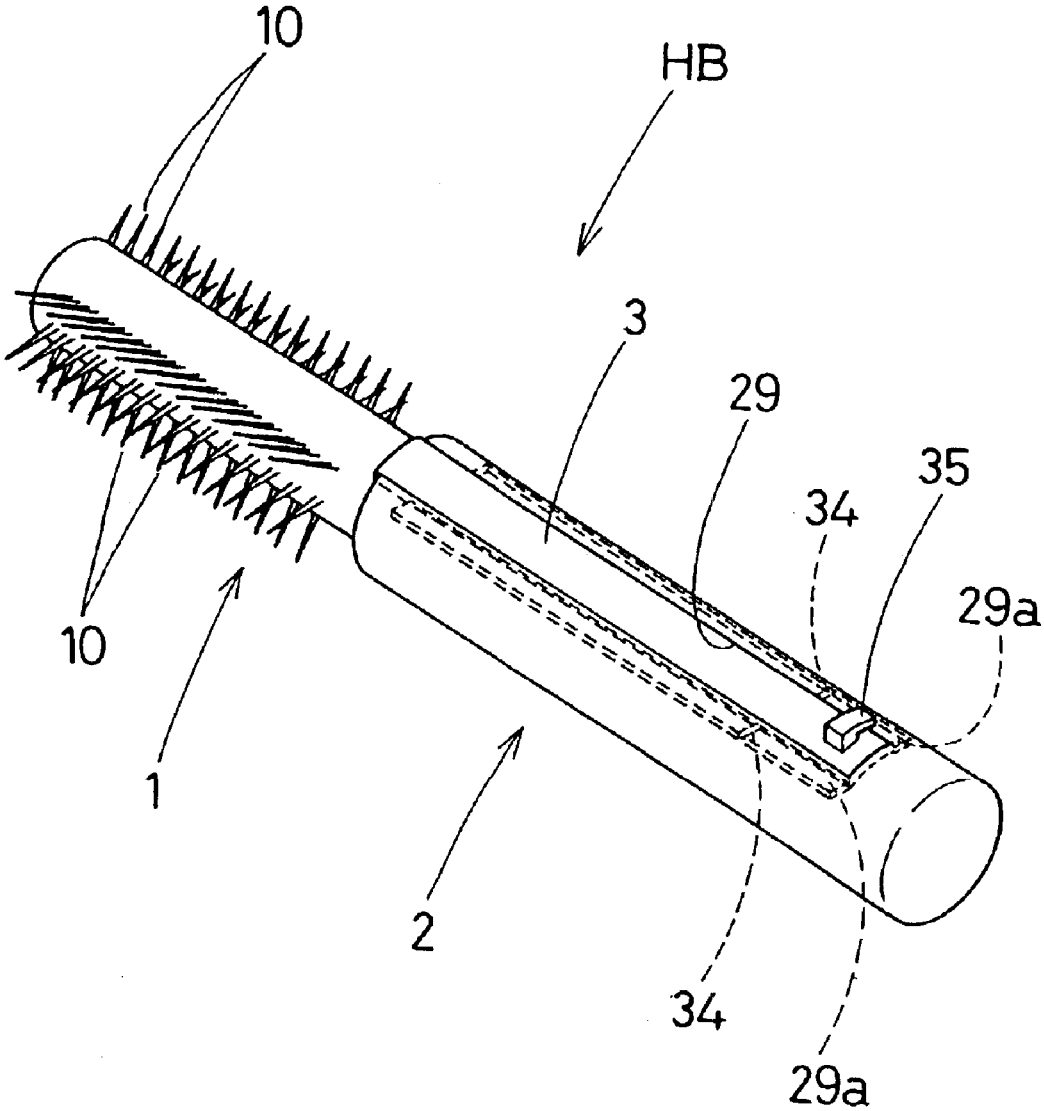
FIG. 13 is a perspective view of Embodiment 5 of a hairbrush according to the present invention.

FIG. 13 is an external perspective view of Embodiment 5 of a hairbrush HB according to the present invention.

As shown in FIG. 13, in the hairbrush of this embodiment, a cylindrical handle 2 is provided with a hollow 29 on its surface having a longitudinal length. (A bottom portion of the hollow 29 is widened to form a hollow 29*a*.) The hollow 29 is provided with a hair holder 3 having a controller 35. The hair holder 3 is slidable within the hollow 29 and prevented from slipping off the hollow 29.

As shown in FIG. 13, the hair holder 3 has the same curved shape as a brush base 1 implanted with brushing bristles so that hair is received by entire surface of the hair holder 3. The hair holder 3 is moved to "a front position" or "a back position" by pushing or pulling the controller 35 with a user's finger.

As shown in FIG. 13, stoppers 34 provided on left and right sides of the hair holder 3 are abutted against a front side constitutional wall of the hollow 29*a* so that the hair holder 3 is prevented from longitudinally coming off the handle 2. The hair holder 3 is also prevented from vertically coming off the handle 2 by an upper side constitutional wall of the hollow 29*a*.

In this embodiment, the controller 35 has the same function as the control member 4 of Embodiment 1 although the controller 35 is controlled by a user's finger.

As a result, the hairbrush HB of this embodiment can produce the same effects as the hairbrush HB of Embodiment 1.

(Other Embodiments)

Although the hairbrushes HB of Embodiment 1 through Embodiment 3 have three hair holders 3, the number of the hair holder 3 is not limited to three. A hairbrush of other embodiments may have only one hair holder 3, two hair holders 3 or more than four hair holders 3.

In Embodiment 1 through Embodiment 3, the only tip portion of the hair holder 3 is projecting toward the brush base 1 from the hollow portion of the handle 2. (Almost an entire body of the hair holder 3 is housed in the handle 2.) However, in other embodiments, entire body of the hair holder 3 including the tip portion may be housed in the handle 2.

Although the brush bases 1 of Embodiment 1 through Embodiment 3 are provided with the stopper 11 near the front edge side to abut the tip portion of the hair holder 3 that is extended to the front position, a hairbrush of other embodiments may not be provided with the stopper 11. In this case, the enlarged-diameter part 30 may not have to be made of magnetic metal. In Embodiment 4 and Embodiment 5, the stopper 11 may be provided at the front edge side of the brush base 1 to abut the tip portion of the hair holder 3 that is moved to the front position. In Embodiment 1 through Embodiment 5, the stopper 11 is not limited to a magnet. The stopper 11 may be made of whatever to be capable of abutting the hair holder 3.

Although the brushing bristles 10 are made of hard bristles in Embodiment 1 through Embodiment 5, they may be made of a combination of the hard bristles and bundles of bristles (animal bristles, resin bristles) or only bundles of bristles in other embodiments.

Although the pole-type hair holder 3 is used in Embodiment 1 through Embodiment 3, a narrow plate-type hair holder 3 that has high rigidity may be used in other embodiments.

Although a common type of hairbrush is used to describe the hairbrush HB of Embodiment 1 through Embodiment 5, a hairbrush including a hairdryer may be used in other embodiments. In this case, a user holds the hairbrush HB including a hairdryer with one hand and the user controls the hair holder 3 with the other hand.

The hairbrush HB according to the present invention having the above mentioned structures produces the following effect.

The hairbrush HB enables a user to style hairdos beautifully without much experience by blowing hair to flow softly or giving hair waves and curls as clearly described in the above "Detailed Description of the Invention".

What is claimed is:

1. A hairbrush comprising:

a brush base having a plurality of brushing bristles;

a handle provided thereto;

at least one hair holder extending longitudinally along with the brush base; and a control member making the hair holder extend and shorten longitudinally; wherein the control member and an entire body except for at least a tip portion of the hair holder are positioned at the handle;

the hair holder is extended and shortened by the control member within an area ranging from a back position where the hair holder is shortened to be positioned at the handle as mentioned above to a front position where the hair holder is extended so that a tip portion thereof reaches near a front edge of the brush base; and hair is received between the brush base and the hair holder when the hair holder is extended to the front position.

2. The hairbrush according to claim 1, wherein the handle is formed to be hollow so that the control member and an entire body except for at least a tip portion of the hair holder are housed in a hollow handle.

3. The hairbrush according to claim 1, wherein there is no brushing bristles on a path which the hair holder moves through.

4. The hairbrush according to claim 2, wherein there is no brushing bristles on a path which the hair holder moves through.

5. The hairbrush according to claim 1, wherein a stopper is provided near a front edge of the brush base to abut the hair holder that is extended to the front position.

6. The hairbrush according to claim 2, wherein a stopper is provided near a front edge of the brush base to abut the hair holder that is extended to the front position.

7. The hairbrush according to claim 3, wherein a stopper is provided near a front edge of the brush base to abut the hair holder that is extended to the front position.

8. The hairbrush according to claim 4, wherein a stopper is provided near a front edge of the brush base to abut the hair holder that is extended to the front position.

9. The hairbrush according to claim 1, wherein the brushing bristles are implanted on the brush base.

10. The hairbrush according to claim 2, wherein the brushing bristles are implanted on the brush base.

11. The hairbrush according to claim 3, wherein the brushing bristles are implanted on the brush base.

12. The hairbrush according to claim 4, wherein the brushing bristles are implanted on the brush base.

13. The hairbrush according to claim 5, wherein the brushing bristles are implanted on the brush base.

14. The hairbrush according to claim 6, wherein the brushing bristles are implanted on the brush base.

15. The hairbrush according to claim 7, wherein the brushing bristles are implanted on the brush base.

16. The hairbrush according to claim 8, wherein the brushing bristles are implanted on the brush base.

17. The hairbrush according to claim 1, wherein more than one hair holders are provided.

18. The hairbrush according to claim 2, wherein more than one hair holders are provided.

19. The hairbrush according to claim 3, wherein more than one hair holders are provided.

20. The hairbrush according to claim 4, wherein more than one hair holders are provided.

21. The hairbrush according to claim 5, wherein more than one hair holders are provided.

22. The hairbrush according to claim 6, wherein more than one hair holders are provided.

23. The hairbrush according to claim 7, wherein more than one hair holders are provided.

24. The hairbrush according to claim 8, wherein more than one hair holders are provided.

25. The hairbrush according to claim 9, wherein more than one hair holders are provided.

26. The hairbrush according to claim 10, wherein more than one hair holders are provided.

27. The hairbrush according to claim 11, wherein more than one hair holders are provided.

28. The hairbrush according to claim 12, wherein more than one hair holders are provided.

29. The hairbrush according to claim 13, wherein more than one hair holders are provided.

30. The hairbrush according to claim 14, wherein more than one hair holders are provided.

31. The hairbrush according to claim 15, wherein more than one hair holders are provided.

32. The hairbrush according to claim 16, wherein more than one hair holders are provided.

33. The hairbrush according to claim 1, wherein the brushing bristles are made of at least one of hard bristles and bundles of bristles.

34. The hairbrush according to claim 2, wherein the brushing bristles are made of at least one of hard bristles and bundles of bristles.

35. The hairbrush according to claim 3, wherein the brushing bristles are made of at least one of hard bristles and bundles of bristles.

36. The hairbrush according to claim 4, wherein the brushing bristles are made of at least one of hard bristles and bundles of bristles.

37. The hairbrush according to claim 5, wherein the brushing bristles are made of at least one of hard bristles and bundles of bristles.

38. The hairbrush according to claim 6, wherein the brushing bristles are made of at least one of hard bristles and bundles of bristles.

39. The hairbrush according to claim 7, wherein the brushing bristles are made of at least one of hard bristles and bundles of bristles.

40. The hairbrush according to claim 8, wherein the brushing bristles are made of at least one of hard bristles and bundles of bristles.

41. The hairbrush according to claim 9, wherein the brushing bristles are made of at least one of hard bristles and bundles of bristles.

42. The hairbrush according to claim 10, wherein the brushing bristles are made of at least one of hard bristles and bundles of bristles.

43. The hairbrush according to claim 11, wherein the brushing bristles are made of at least one of hard bristles and bundles of bristles.

44. The hairbrush according to claim 12, wherein the brushing bristles are made of at least one of hard bristles and bundles of bristles.

45. The hairbrush according to claim 13, wherein the brushing bristles are made of at least one of hard bristles and bundles of bristles.

46. The hairbrush according to claim 14, wherein the brushing bristles are made of at least one of hard bristles and bundles of bristles.

47. The hairbrush according to claim 15, wherein the brushing bristles are made of at least one of hard bristles and bundles of bristles.

48. The hairbrush according to claim 16, wherein the brushing bristles are made of at least one of hard bristles and bundles of bristles.

49. The hairbrush according to claim 17, wherein the brushing bristles are made of at least one of hard bristles and bundles of bristles.

50. The hairbrush according to claim 18, wherein the brushing bristles are made of at least one of hard bristles and bundles of bristles.

51. The hairbrush according to claim 19, wherein the brushing bristles are made of at least one of hard bristles and bundles of bristles.

52. The hairbrush according to claim 20, wherein the brushing bristles are made of at least one of hard bristles and bundles of bristles.

53. The hairbrush according to claim 21, wherein the brushing bristles are made of at least one of hard bristles and bundles of bristles.

54. The hairbrush according to claim 22, wherein the brushing bristles are made of at least one of hard bristles and bundles of bristles.

55. The hairbrush according to claim 23, wherein the brushing bristles are made of at least one of hard bristles and bundles of bristles.

56. The hairbrush according to claim 24, wherein the brushing bristles are made of at least one of hard bristles and bundles of bristles.

57. The hairbrush according to claim 25, wherein the brushing bristles are made of at least one of hard bristles and bundles of bristles.

58. The hairbrush according to claim 26, wherein the brushing bristles are made of at least one of hard bristles and bundles of bristles.

59. The hairbrush according to claim 27, wherein the brushing bristles are made of at least one of hard bristles and bundles of bristles.

60. The hairbrush according to claim 28, wherein the brushing bristles are made of at least one of hard bristles and bundles of bristles.

61. The hairbrush according to claim 29, wherein the brushing bristles are made of at least one of hard bristles and bundles of bristles.

62. The hairbrush according to claim 30, wherein the brushing bristles are made of at least one of hard bristles and bundles of bristles.

63. The hairbrush according to claim 31, wherein the brushing bristles are made of at least one of hard bristles and bundles of bristles.

64. The hairbrush according to claim 32, wherein the brushing bristles are made of at least one of hard bristles and bundles of bristles.

* * * * *